US008448687B2

(12) United States Patent
Saccomanno

(10) Patent No.: US 8,448,687 B2
(45) Date of Patent: May 28, 2013

(54) WIRE SUPPORTS, MOVABLE PARTITION SYSTEMS INCLUDING SUCH WIRE SUPPORTS, AND RELATED METHODS

(75) Inventor: Paul Saccomanno, West Valley City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

(21) Appl. No.: 13/185,303

(22) Filed: Jul. 18, 2011

(65) Prior Publication Data

US 2013/0020033 A1 Jan. 24, 2013

(51) Int. Cl.
*A47H 5/00* (2006.01)

(52) U.S. Cl.
USPC ..... 160/84.02; 160/188; 160/196.1; 160/331

(58) Field of Classification Search
USPC ..... 160/196.1, 331, 188, 84.02; 248/53, 248/58, 74.1; 104/288
IPC ..... H02G 11/00
See application file for complete search history.

(56) References Cited

U.S. PATENT DOCUMENTS 1,378,667 A * 5/1921 Eckert ..... 24/135 R
2,122,988 A * 7/1938 Nelson ..... 378/194
2,364,477 A * 12/1944 Sayles et al. ..... 248/231.61
2,571,832 A 10/1951 Chapin, Jr.
2,853,026 A 9/1958 Paul
2,854,680 A 10/1958 Wilson
2,858,381 A 10/1958 Goldberg et al.
2,893,518 A 7/1959 Vanderbeck
3,802,351 A 4/1974 Pascuzzi
4,078,769 A 3/1978 Wamfler
4,387,887 A * 6/1983 Gentry ..... 269/100
4,702,175 A * 10/1987 Brudereck et al. ..... 105/154
4,834,161 A 5/1989 Johnson et al.
4,924,929 A 5/1990 Johnson et al.
5,322,132 A 6/1994 Franks
5,638,639 A 6/1997 Goodman et al.
5,676,189 A 10/1997 Zeeb
6,662,848 B2 12/2003 Goodman et al.
7,050,283 B2 5/2006 Field et al.
7,066,297 B2 * 6/2006 Goodman et al. ..... 160/84.02
7,190,132 B2 3/2007 Goodman et al.
7,478,663 B2 1/2009 Goodman et al.
7,513,293 B2 4/2009 Goodman et al.
7,656,129 B2 2/2010 Banta et al.

(Continued)

FOREIGN PATENT DOCUMENTS

DE 10009245 A1 9/2001

*Primary Examiner* — Blair M. Johnson
(74) *Attorney, Agent, or Firm* — TraskBritt

(57) ABSTRACT

Wire supports for use with a movable partition system comprise a cantilever member configured for connection to a panel of a movable partition. A wire-supporting member through which wire may be inserted is rotatably connected to the cantilever member. Movable partition systems comprise a movable partition comprising at least two sheets of panels extending at least substantially parallel to one another and laterally distanced from one another to define an interior space between the at least two sheets of panels. At least one wire support disposed in the interior space between a proximal end and a distal end of the at least two movable partitions comprises a cantilever member secured to at least one panel of one of the movable partitions and a wire-supporting member rotatably connected to the cantilever member at least partially supporting at least one wire inserted through the wire-supporting member.

27 Claims, 6 Drawing Sheets

U.S. PATENT DOCUMENTS

| | | | | |
|---|---|---|---|---|
| 7,737,860 | B2 | 6/2010 | Banta et al. | |
| 7,740,046 | B2 | 6/2010 | Goodman et al. | |
| 7,782,019 | B2 | 8/2010 | Banta et al. | |
| 7,845,384 | B2 | 12/2010 | Goodman et al. | |
| 7,845,385 | B2 | 12/2010 | Goodman et al. | |
| 7,845,386 | B2 | 12/2010 | Coleman et al. | |
| 7,854,248 | B2 | 12/2010 | Coleman et al. | |
| 7,874,341 | B2 | 1/2011 | Coleman et al. | |
| 7,886,804 | B2 | 2/2011 | Goodman et al. | |
| 7,926,538 | B2 | 4/2011 | Coleman et al. | |
| 7,931,067 | B2 | 4/2011 | Goodman et al. | |
| 2008/0115896 | A1 | 5/2008 | Goodman | |
| 2009/0108146 | A1 | 4/2009 | Svette, Jr. et al. | |
| 2010/0084518 | A1* | 4/2010 | Davis et al. | 248/68.1 |
| 2010/0102764 | A1 | 4/2010 | Banta et al. | |
| 2010/0214709 | A1 | 8/2010 | Hall et al. | |
| 2010/0299889 | A1 | 12/2010 | George | |
| 2011/0000625 | A1 | 1/2011 | George | |
| 2011/0005689 | A1 | 1/2011 | Coleman et al. | |
| 2011/0024061 | A1 | 2/2011 | Bell et al. | |
| 2011/0036016 | A1 | 2/2011 | Knight et al. | |
| 2011/0036509 | A1 | 2/2011 | Goodman et al. | |
| 2011/0036513 | A1 | 2/2011 | Banta et al. | |
| 2011/0061820 | A1 | 3/2011 | Coleman et al. | |
| 2011/0088322 | A1 | 4/2011 | Coleman et al. | |
| 2011/0093095 | A1 | 4/2011 | Goodman et al. | |
| 2011/0247275 | A1 | 10/2011 | Coleman et al. | |
| 2012/0012259 | A1 | 1/2012 | Goodman | |
| 2012/0061527 | A1* | 3/2012 | Spies et al. | 248/58 |

* cited by examiner

WIRE SUPPORTS, MOVABLE PARTITION SYSTEMS INCLUDING SUCH WIRE SUPPORTS, AND RELATED METHODS

CROSS-REFERENCE TO RELATED APPLICATION

The subject matter of this application is related to the subject matter of co-pending U.S. patent application Ser. No. 13/185,325 to Stewart, which was filed on Jul. 18, 2011 and is entitled "WIRE TROLLEYS, MOVABLE PARTITION SYSTEMS INCLUDING SUCH WIRE TROLLEYS, AND RELATED METHODS," the disclosure of which is incorporated herein in its entirety by this reference.

FIELD

Embodiments of the disclosure relate generally to wire supports for movable partition systems, movable partition systems including such wire supports, and related methods. Specifically, embodiments of the disclosure relate to wire supports for suspending wires extending within a space between two movable partitions.

BACKGROUND

Movable partitions are utilized in numerous situations and environments for a variety of purposes. Such partitions may include for example, foldable or collapsible doors configured to close off an opening in order to enclose a room or to subdivide a single large room into one or more smaller rooms. The subdivision of one or more larger areas may be desired, for example, to accommodate the simultaneous meeting of multiple groups in different areas of a larger partitioned space. In some applications, movable partitions are useful for providing privacy and noise reduction. In some applications, movable partitions are useful for providing a barrier, such as, for example, a security barrier or a fire barrier.

A partition system may further include wires extending from one end of the partition system to an opposite end of the partition system. For example, wires may connect an AC or DC electrical power supply at one end of a movable partition to a drive motor for extending and retracting the movable partition at an opposing end of the movable partition. In addition, wires may electrically interconnect various components (e.g., switches, sensors, and controllers) of one or more electronic systems of the movable partition system, such as to alarm systems, partition monitoring systems, and partition control systems. In previously known partition systems, wires have been located in a space within the movable partition between two parallel extending sheets of folding panels that together define the movable partition. Wires are typically connected to individual panels of one of the sheets of folding panels using clips to support the wires as they extend from one end of the movable partition to the opposing end of the movable partition. Thus, the wires are coupled to the interior surfaces of the folding panels, and bend in conformity with the panels in an accordion-style fashion as the movable partition is extended and retracted.

BRIEF DESCRIPTION OF THE DRAWINGS

While the specification concludes with claims particularly pointing out and distinctly claiming what are regarded embodiments of the invention, various features and advantages of disclosed embodiments may be more readily ascertained from the following description of some example embodiments when read in conjunction with the accompanying drawings, in which:

DETAILED DESCRIPTION

The illustrations presented herein are not meant to be actual views of any particular wire support, movable partition system, or component thereof, but are merely idealized representations that are employed to describe example embodiments. Thus, the drawings are not necessarily to scale and relative dimensions may have been exaggerated for the sake of clarity. Additionally, elements common between figures may retain the same or similar numerical designation.

Embodiments of the disclosure relate generally to wire supports for movable partition systems, movable partition systems including such wire supports, and related methods. Specifically, embodiments of the disclosure relate to wire supports for suspending wires extending within a space between two movable partitions.

Figure 1:
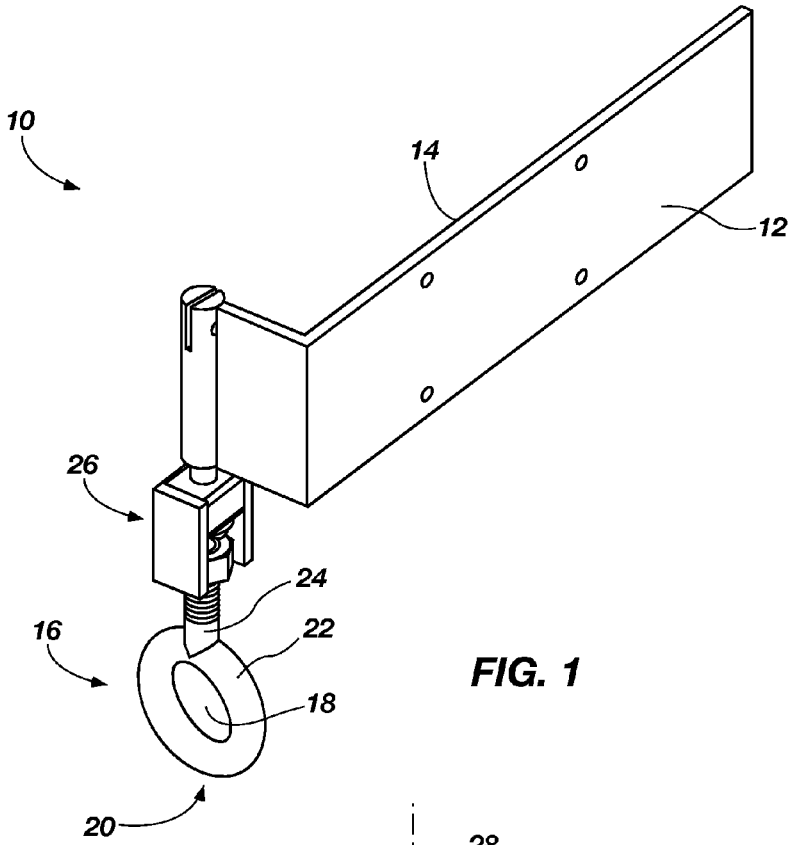
FIG. 1 is a perspective view of a wire support.

Referring to FIG. 1, a perspective view of a wire support 10 is shown. The wire support 10 may be configured for use with a movable partition system, and may include a cantilever member 12 configured for connection to a panel of a movable partition. The cantilever member 12 may comprise a connection surface 14 configured to abut a panel of a movable partition. The cantilever member 12 may comprise a generally L-shaped member, which may be secured to a panel of a movable partition and extend away from the panel. In some embodiments, the L-shaped member may be configured to extend away from the panel toward an interior space within a movable partition comprising the panel. Specifically, the cantilever member 12 may comprise sheet metal having an optional at least substantially 90° bend and an at least substantially planar connection surface 14 that may abut a panel of a movable partition when the cantilever member 12 is secured to the panel.

A wire-supporting member 16 through which wire may be inserted and from which wire may be suspended may be rotatably connected to the cantilever member 12. For example, the wire-supporting member 16 may include a space 18 through which wire may extend and a supporting structure 20 located below the space from which the wire may be suspended. The supporting structure 20 of the wire-supporting member 16 may comprise a loop 22 of an eyebolt 24 in some embodiments. In other embodiments, the wire-supporting member 16 may comprise a loop, an eyelet, a grommet, a section of non-corrugated conduit, a hook, or any other structure known in the art through which wire may be inserted and from which wire may be suspended. In some embodiments, an optional section of corrugated conduit (not shown) through which wire may extend may be inserted through and retained by the loop 22.

The wire-supporting member 16 may be connected to the cantilever member 12 using a rotatable connection 26. The rotatable connection 26 may enable the wire-supporting member 16 to swivel and pivot with respect to the cantilever member 12. Additional detail regarding the rotatable connection 26 is provided below in connection with the discussion of FIG. 3, which more clearly depicts one embodiment of a rotatable connection 26.

Figure 2:
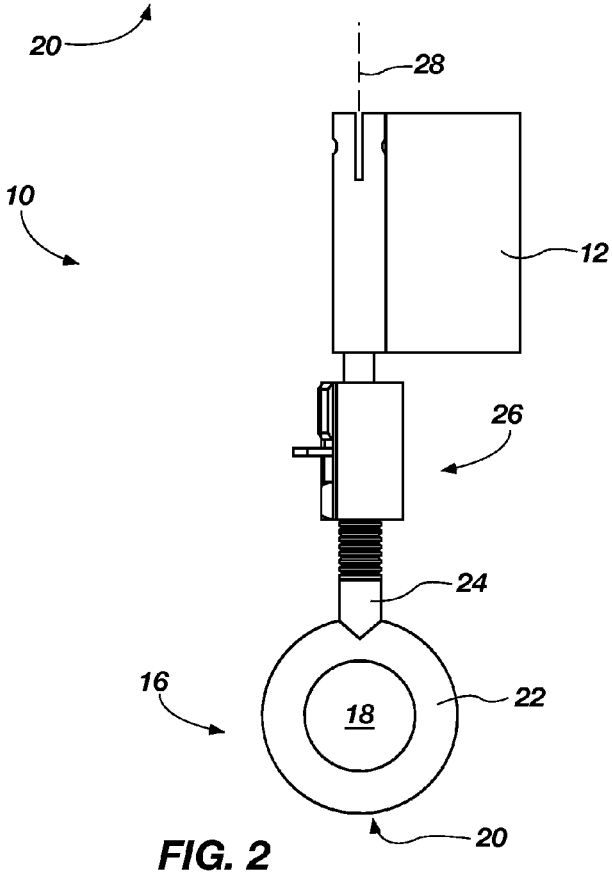
FIG. 2 depicts a front view of the wire support of FIG. 1.
Figure 3:
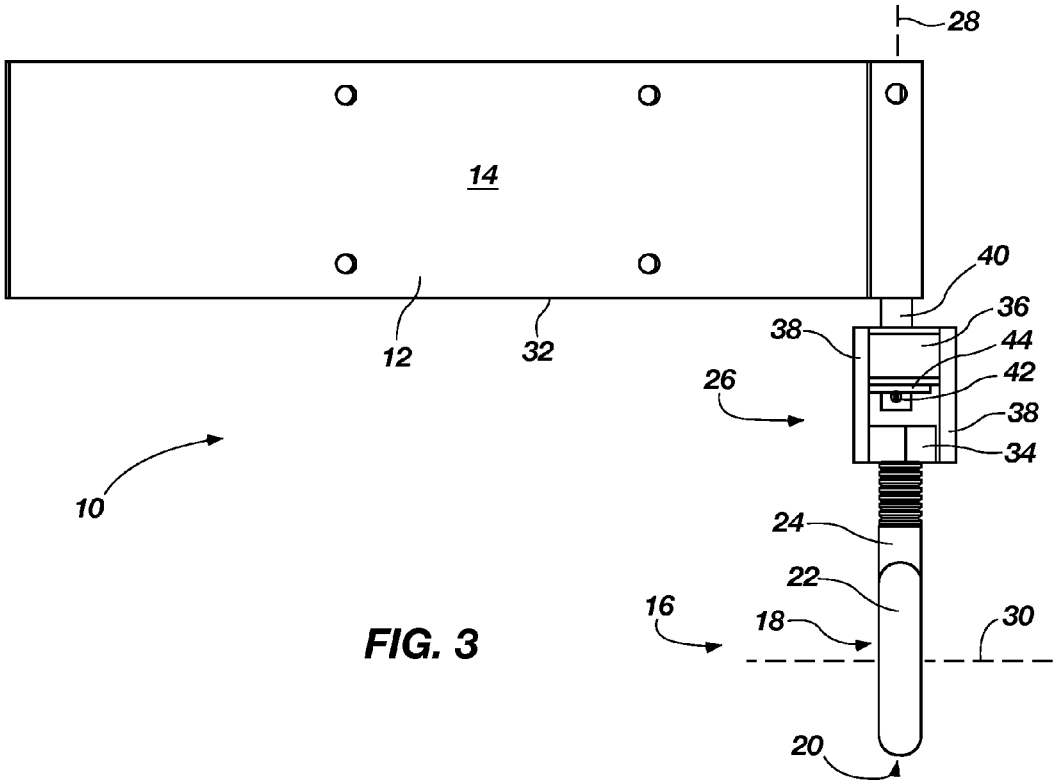
FIG. 3 illustrates a side view of the wire support of FIG. 1.

Referring to FIGS. 2 and 3, a front view and a side view of the wire support 10 of FIG. 1 are shown, respectively. As best shown in FIG. 2, an axis of rotation 28 of the wire-supporting member 16 extends in a vertical direction parallel to the plane of the connection surface 14 (see FIG. 1) of the cantilever member 12. As best shown in FIG. 3, a central axis 30 of the space 18 through which wire may be inserted may extend in a horizontal direction parallel to a lower surface 32 of the cantilever member 12. Accordingly, the axis of rotation 28 of the wire-supporting member 16 may extend in a vertical direction transverse to a horizontal direction in which the central axis 30 of the space 18 of the wire-supporting member 16 through which wire may be inserted extends.

With continued reference to FIG. 3, the rotatable connection 26 may comprise, for example, a threaded connection 34 (e.g., a nut or lock nut) threadedly engaged with threads of the eyebolt 24. Thus, the wire-supporting member 16 may be connected to the rotatable connection 26 using a threaded connection 34 in some embodiments. In other embodiments, the wire-supporting member 16 may be adhesively joined to, welded to, riveted to, integrally formed with, or joined using another structure known in the art to the rotatable connection 26. A rotating, load-bearing member 36 may be positioned above and connected to the threaded connection 34. For example, lateral support members 38 may be adhesively joined, welded, integrally formed with, or otherwise connected to the threaded connection 34 and the rotating, load-bearing member 36. An axle 40 may extend through and be connected to the rotating, load-bearing member 36. For example, a pin 42 may extend through a hole in the axel 40 and the rotating, load-bearing member 36 may rest on the pin 42. An optional washer 44 may be disposed between the rotating, load-bearing member 36 and the pin 42 in some embodiments. The axel 40 may be adhesively joined to, welded to, riveted to, integrally formed with, or otherwise connected to the cantilever member 12. Thus, as the wire-supporting member 16 swivels or pivots about the axis of rotation 28, the rotating, load-bearing member 36 may freely rotate on the pin 42 or washer 44 on which it rests. Further, the rotatable connection 26 of the wire support 10, and the entire wire support 10, may be constructed from parts and materials generally readily available to makers of movable partition systems in some embodiments. In other embodiments, the rotatable connection 26 may comprise a separately acquired or made hinge or other connection that enables rotation of the wire-supporting member 16 relative to the cantilever member 12.

Figure 4:
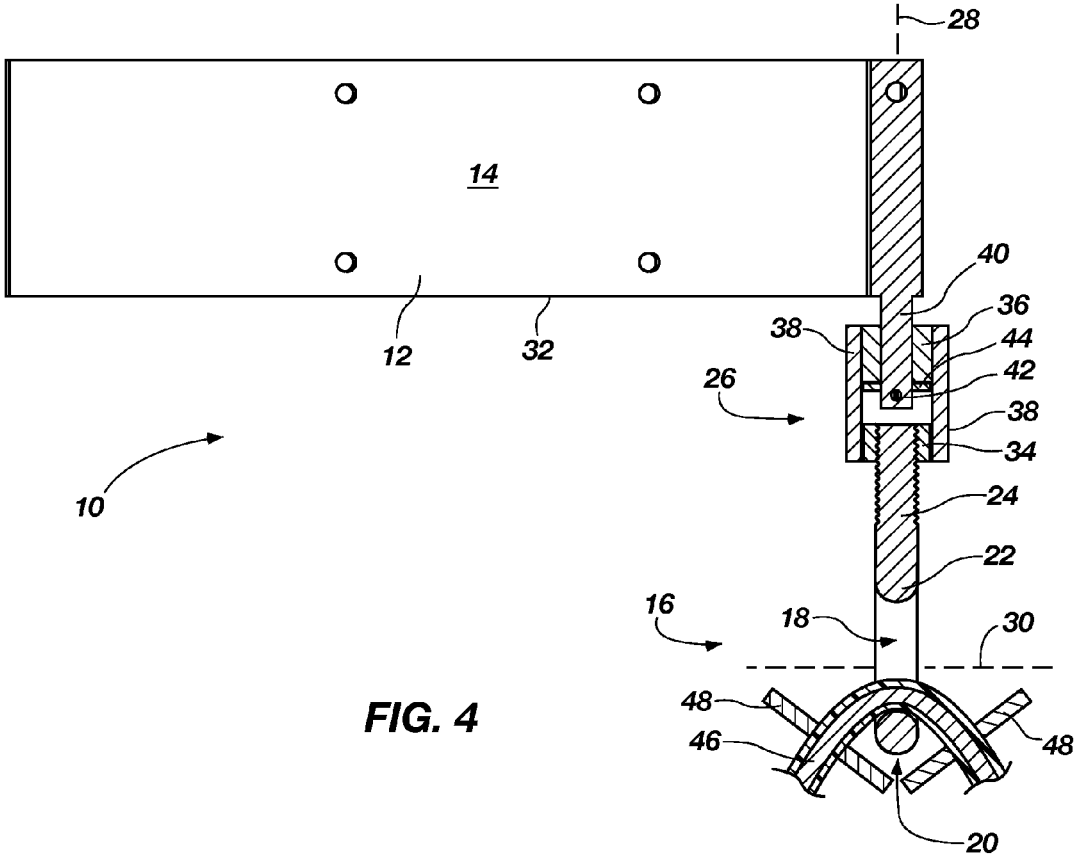
FIG. 4 is a cross-sectional side view of the wire support of FIG. 1 supporting a wire.

Referring to FIG. 4, a cross-sectional side view of the wire support 10 of FIG. 1 supporting a wire 46 is shown. The wire 46 is threaded through the space 18 in the wire-supporting member 16 and is supported by the supporting structure 20. Retaining members 48 may be secured around the wire 46 and may maintain the wire 46 in at least substantially the same position relative to the wire support 10 during displacement of the wire support 10. Explaining further, as the wire support 10 is displaced (e.g., through movement of a panel of a movable partition to which the wire support 10 may be connected), the wire 46 may shift through the space 18 in the wire-supporting member 16, leaving a longer length of wire 46 on one side of the wire support 10 than was previously on that side of the wire support 10. Thus, the retaining members 48 may maintain the lengths of wire 46 disposed on each side of the wire support 10 at their respective lengths. The retaining members 48 may comprise, for example, washers having a diameter larger than a diameter of the space 18 through which the wire 46 extends or other structures known in the art that are connectable to the wire 46 and are larger than the diameter of the space 18 through which the wire 46 extends.

Figure 5:
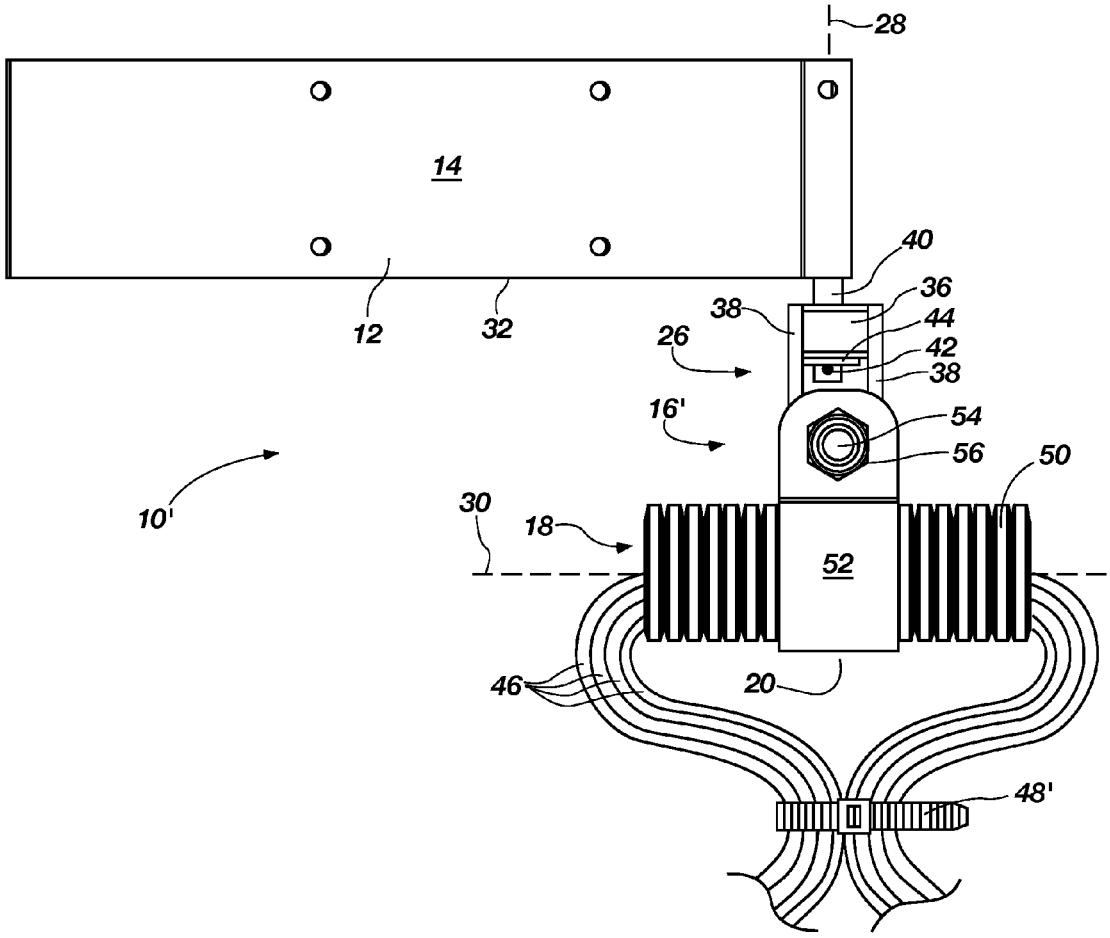
FIG. 5 depicts a side view of another embodiment of a wire support.

Referring to FIG. 5, a side view of another embodiment of a wire support 10' is shown. Rather than the eyebolt 24, as shown in FIGS. 1 through 4, the wire-supporting member 16' may comprise an optional section of corrugated conduit 50 secured by a conduit clamp 52 in some embodiments. The section of corrugated conduit 50 may extend through the conduit clamp 52, and a securing member may constrict the conduit clamp 52 around the section of corrugated conduit 50 to hold the corrugated conduit 50 in place. For example, a bolt 54 and locknut 56, a pin connection, a screw, or other securing members known in the art may constrict the conduit clamp 52 to hold the corrugated conduit 50 in place. The securing member (e.g., the bolt 54 and locknut 56) may also connect the conduit clamp 52 to the rotatable connection 26, such as, for example, by being inserted through a plate or other member (not shown) adhesively joined to, welded to, integrally formed with, or otherwise connected to the lateral support members 38.

As further shown in FIG. 5, a plurality of wires 46 may be inserted through the space 18 of the wire-retaining member 16'. A retaining member 48' may secure portions of the plurality of wires 46 extending from two opposing sides of the wire-supporting member 16' to one another. The retaining member 48' may comprise, for example, a cable tie. Thus, a single retaining member 48' may maintain the lengths of a bundle of wires 46 disposed on each side of the wire support 10' at their respective lengths.

Figure 6:
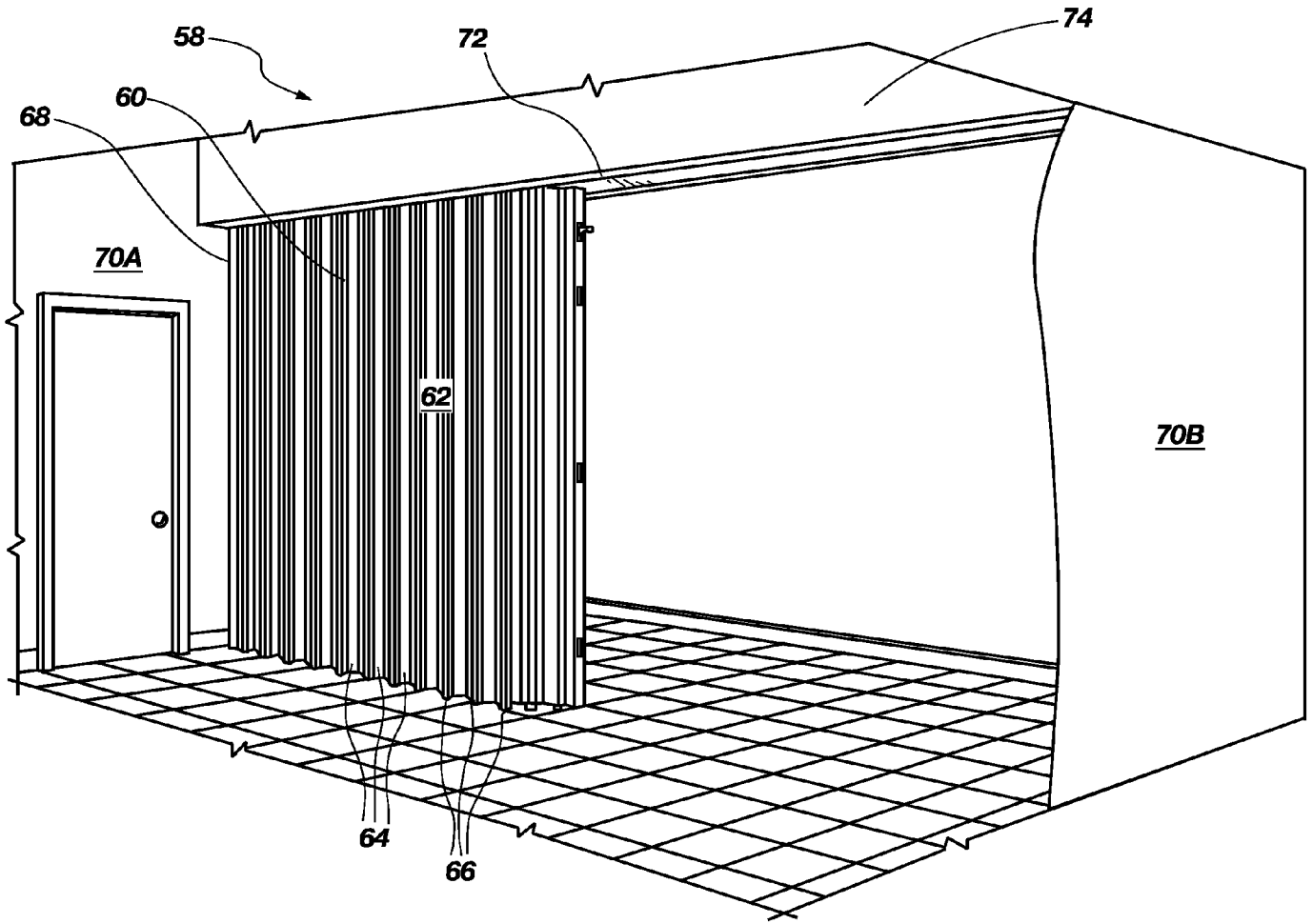
FIG. 6 illustrates a simplified perspective view of a movable partition system.

Referring to FIG. 6, a simplified perspective view of a movable partition system 58 is shown. The movable partition system 58 may be an automatic movable partition system, in that the movable partition system 58 includes a movable partition 60 that may be automatically extended, automatically retracted, or both automatically extended and automatically retracted. The movable partition 60 also may be manually extended, manually retracted, or both manually extended and manually retracted. In other words, the movable partition 60 may be moved both automatically and manually, as desirable. The movable partition 60 may be used for partitioning space, as a sound barrier, as a fire barrier, as a security barrier, for combinations of such purposes, or for other purposes.

The movable partition 60 may comprise, for example, an accordion-type folding door. The movable partition 60 may include two sheets of panels 62 extending at least substantially parallel to one another connected at their ends to define an interior space between the sheets of panels 62. Each sheet of panels 62 may include a plurality of panels 64 hingedly connected to one another with hinges or other hinge-like members 66, which may comprise separate structures from the panels 64 or may be integrally formed with the panels 64 and interconnected to form the sheet of panels 62. The hinged connection of the panels 64 enables the panels 64 to fold, and the movable partition 60 to collapse, in a plicated manner as the movable partition 60 is retracted, which enables the movable partition 60 to be stored compactly in a pocket 68 formed in a wall 70A of a building when in a retracted state. In other embodiments, the movable partition 60 may comprise a sliding door, or another type of movable partition 60.

When the movable partition 60 is deployed to an extended position, the movable partition 60 is driven along a track 72 across the space to provide an appropriate barrier. The track 72 may comprise an overhead track disposed in a header assembly 74. In such embodiments, the movable partition 60 may be suspended from and movable along the track 72.

Figure 7:
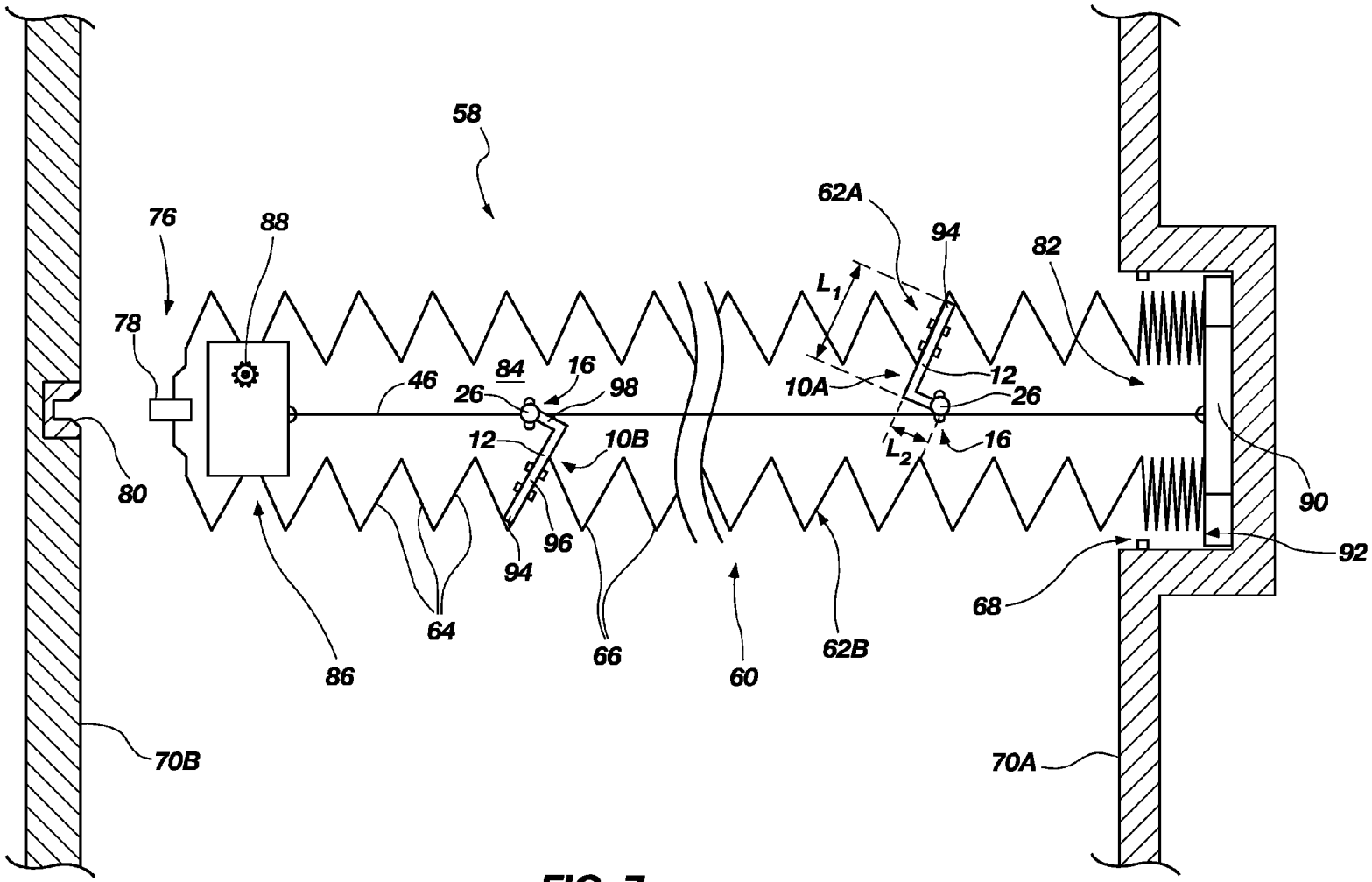
FIG. 7 is a simplified plan view of the movable partition system of FIG. 6.

Referring to FIG. 7, a simplified plan view of the movable partition system 58 of FIG. 6 is shown. A first end 76 of the movable partition 60, which may comprise a lead post 78, may be configured to matingly (i.e., complementarily) engage with a door post 80 that may be formed in another wall 70B of a building when the movable partition 60 is deployed to a fully extended state. A second, opposing end 82 of the movable partition 60 may be located opposite the first end 76 and may be disposed in the pocket 68. In other embodiments, the lead post 78 may matingly engage with a lead post (not shown) of another movable partition assembly (not shown), which may likewise be suspended from the track 72 (see FIG. 6), conventionally known as a bi-part configuration. Such an additional movable partition assembly with a lead post (not shown) may also be configured to move automatically, manually, or automatically and manually.

The movable partition system 58 may include a first sheet of panels 62A and a second sheet of panels 62B laterally spaced from and extending substantially parallel to the first sheet of panels 62A. The first ends 76 of the first and second sheets of panels 62A and 62B may be attached at or near the lead post 78. For example, the first and second sheets of panels 62A and 62B may be attached directly to the lead post 78, may be attached to one another and then to the lead post 78, or may be attached to an intermediate structure that is then attached to the lead post 78. Such a movable partition 60 may be used, for example, as a fire door, wherein one sheet of panels 62A acts as a primary fire and smoke barrier, an interior space 84 between the first sheet of panels 62A and the second sheet of panels 62B acts as an insulator or a buffer, and the second sheet of panels 62B acts as a secondary fire and smoke barrier. Such a configuration may also be useful in providing an acoustic barrier when the movable partition 60 is used to subdivide a larger space into multiple rooms.

In some embodiments, the movable partition system 58 may also include an automatic drive system 86. The automatic drive system 86 may be disposed in the interior space 84 between the first sheet of panels 62A and the second sheet of panels 62B. The automatic drive system 86 may be attached to and carried by the movable partition 60, and may move cooperatively therewith as the movable partition 60 is extended or retracted. In some embodiments, all of the drive components of the movable partition system 58 may be confined between the first sheet of panels 62A and the second sheet of panels 62B.

The automatic drive system 86 may be positioned near the lead post 78 of the movable partition system 58. The automatic drive system 86 may include a motor (not shown) carried by the movable partition 60 as described in detail in U.S. patent application Ser. No. 12/542,448 which was filed Aug. 17, 2009 and is entitled "Methods, Apparatuses, and Systems for Driving a Movable Partition," in U.S. patent application Ser. No. 12/758,584, which was filed Apr. 12, 2010 and is entitled "Methods, Apparatuses, and Systems for Movable Partitions," and in U.S. patent application Ser. No. 12/838,235, which was filed Jul. 16, 2010 and is entitled "Methods, Apparatuses, and Systems for Movable Partitions," the disclosure of each of which is hereby incorporated herein in its entirety by this reference. Briefly, the automatic drive system 86 may be configured to automatically open, automatically close, or to both automatically open and automatically close the movable partition 60 upon actuation thereof. The automatic drive system 86 may include an elongated drive member (not shown), which may comprise, for example, a chain, belt, cable or rope having fixed ends. A rotatable drive member 88, such as, for example, a pulley, wheel, cog, or sprocket, may be configured to engage the elongated drive member such that when the rotatable drive member 88 is rotated, the rotatable drive member 88 moves along the elongated drive member causing the movable partition 60 to automatically extend to a deployed state or automatically retract to a collapsed state.

In other embodiments, the automatic drive system 86 may comprise a motor or other actuator for extending a movable partition fixedly located in the pocket 68. For example, a drive system as disclosed in U.S. Pat. No. 7,782,019 issued Aug. 24, 2010 to Banta et al., the disclosure of which is incorporated herein in its entirety by this reference, may be used.

The movable partition system 58 may also include a control system 90. For example, the control system 90 may comprise a control system as disclosed in U.S. Pat. No. 6,662,848, issued Dec. 16, 2003 to Goodman et al., the disclosure of which is incorporated herein in its entirety by this reference. The control system 90 may be operatively coupled to the automatic drive system 86 (e.g., using a wire 46 or a plurality of wires 46 as shown in FIGS. 4 and 5) and may control, for example, actuation of the automatic drive system 86 to extend and retract the movable partition 60. The control system 90 may be located at or near the second, opposing end 82 of the movable partition 60. For example, the control system 90 may be located in the pocket 68. The second, opposing ends 82 of the first and second sheets of panels 62A and 62B may be connected to a floating jamb 92, which may also be located within the pocket 68. The control system 90 may be located on a side of the floating jamb 92 opposing the movable partition 60. The control system 90 may comprise, for example, a processor, a power supply, input and output ports, power ports, a battery system, switches, and other components known in the art for controlling the operation of a movable partition system 58.

At least one wire support 10 (e.g., a plurality of wire supports 10) may be disposed in the interior space 84 between the second, opposing end 82 and the first end 76 of the movable partition 60. Each cantilever member 12 may be secured to a panel 64 of one of the first and second sheets of panels 62A and 62B. For example, the cantilever member 12 of a first wire support 10A may be attached to the first sheet of panels 62A and the cantilever member 12 of a second wire support 10B may be attached to the second sheet of panels 62B. Thus, a movable partition system 58 including a plurality of wire supports 10 may include wire supports 10 secured to each sheet of panels 62 of the movable partition 60 in some embodiments. In other embodiments, each wire support 10 may be secured to the same sheet of panels 62, though to different panels 64 of that sheet of panels 62, of the movable partition 60. The wire supports 10 may be connected to the panels 64 by abutting the connection surfaces 14 (see FIGS. 3 through 5) of the cantilever members 12 against the panels 64 and adhesively joining, welding, riveting, screwing, bolting, or otherwise connecting the cantilever members 12 to the panels 64.

The wire-supporting member 16 of at least one wire support 10 may be positioned at least substantially equidistant from the first and second sheets of panels 62A and 62B. For example, the wire-supporting member 16 may be within about 1 inch (2.54 cm) from a location equidistant from the first and second sheets of panels 62A and 62B, may be within about 0.5 inch (1.27 cm) from such a location, or may be located at such a location. An end 94 of the cantilever member 12 located opposite an end to which the rotatable connection 26 is attached may abut a hinge or hinge-like member 66 joining the panel 64 to which the wire support 10 is attached to another panel 64. Accordingly, the cantilever member 12 may have a length and geometry configured to extend between the hinge or hinge-like member 66 and a location equidistant from the first and second sheets of panels 62A and 62B. For example, the cantilever member 12 may comprise an L-shaped member having a first portion 96 connected to the panel and having a first length $L_1$ and a second portion 98 extending at about a 90° angle from the first portion 96 and having a second length $L_2$. The first length $L_1$ may be about 6.5 inches (16.51 cm) and the second length $L_2$ may be about 1 inch (2.54 cm), in some embodiments. For example, the first length $L_1$ may be between about 5.5 inches (13.97 cm) and 7.5 inches (19.05 cm), between about 6 inches (15.24 cm) and 7 inches (17.78 cm), or 6.5 inches (16.51 cm). In a similar manner, the second length $L_2$ may be between about 0.5 inch (1.27 cm) and 1.5 inches (3.81 cm), between about 0.75 inch (1.91 cm) and 1.25 inches (3.18 cm), or 1.0 inch (2.54 cm).

When installing the wire support 10, the end 94 of the cantilever member 12 opposing the end to which the rotatable connection 26 is attached may be abutted against the hinge or hinge-like member 66 of a panel 64 and the connection surface 14 may be abutted against the panel 64. The wire support 10 may then be secured to the panel, for example, by adhesively joining, welding, riveting, screwing, bolting, or otherwise connecting the cantilever member 12 to the panel 64. Thus, the wire support 10 may enable faster and easier installation of the movable partition system 58 as compared to clips connected to individual panels 64 because fewer connections are required and because the shape and configuration of the wire support 10 may enable installation with relatively few actions performed. Forming the cantilever member 12 as an L-shaped member may enable the wire-supporting member 16 to stay in a position at least substantially equidistant from the first and second sheets of panels 62A and 62B because, as the movable partition 60 extends and retracts, the panels 64 to which the wire supports 10 are attached will rotate on their hinges or hinge-like members 66 and the L-shape of the cantilever member 12 may reduce displacement of the wire-supporting member 16 as the wire support 10 rotates along with the panel 64 as compared to a cantilever member 12 that comprises only a straight, first portion 96.

At least one wire 46 may extend in the interior space 84. The wire 46 may be inserted through the wire-supporting member 16 of each wire support 10. Thus, the wire 46 may be suspended from and at least partially supported by the wire supports 10. The wire 46 may extend from the first end 76 of the movable partition 60 to the second, opposing end 82 of the movable partition 60, or may extend to locations near the first and second, opposing ends 76 and 82.

Figure 8:
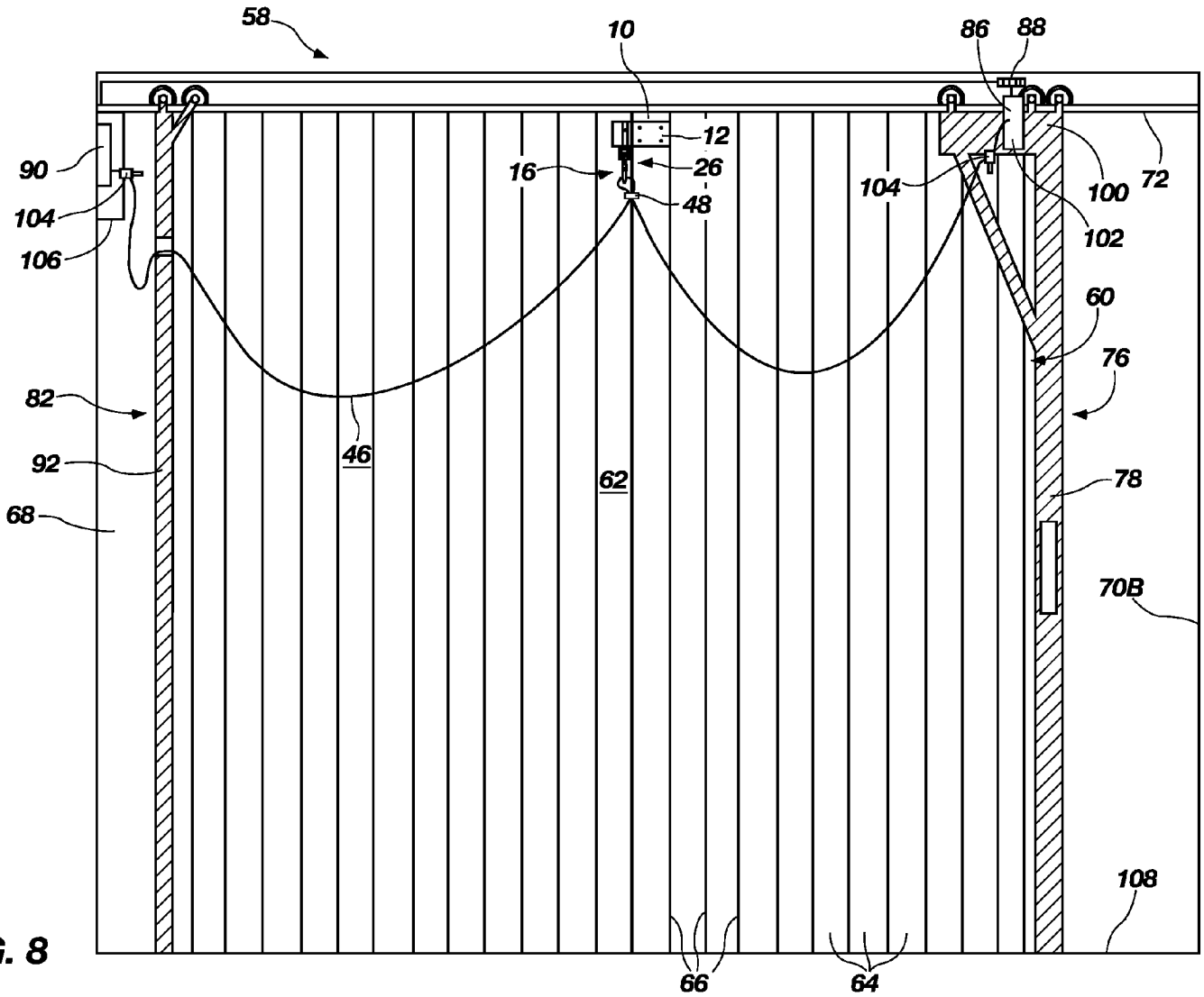
FIG. 8 illustrates a cross-sectional view of the movable partition system of FIG. 6 within an interior space defined by the two movable partitions.

Referring to FIG. 8, a cross-sectional view of the movable partition system of FIG. 6 from within the interior space 84 (see FIG. 7) defined between the first and second sheets of panels 62A and 62B is shown. When installing the movable partition system 58, at least two sheets of panels 62A and 62B (see FIG. 7) extending at least substantially parallel to one another and laterally distanced from one another to define an interior space 84 (see FIG. 7) between the first and second sheets of panels 62A and 62B (see FIG. 7) may be suspended from the track 72. For example, the first and second sheets of panels 62A and 62B may be connected to a lead post 78 suspended from a trolley 100 and a floating jamb 92, which may be in rolling engagement with the track 72, to form a movable partition 60.

At least one wire support 10 comprising a cantilever member 12 and a wire-supporting member 16, through which wire 46 may be inserted, rotatably connected to the cantilever member 12 may be connected to at least one panel 64 of a sheet of panels 62 in the interior space 84 (see FIG. 7) between the first end 76 and the second, opposing end 82 of the movable partition 60. For example, the wire supports 10 may be connected to the panels 64 by abutting the connection surfaces 14 (see FIGS. 3 through 5) of the cantilever members 12 against the panels 64 and adhesively joining, welding, riveting, screwing, bolting, or otherwise connecting the cantilever members 12 to the panels 64. At least one wire 46 located in the interior space 84 (see FIG. 7) may extend from the first end 76, through the wire-supporting member 16, to the second, opposing end 82 of the movable partition 60 in some embodiments. In other embodiments, the wire 46 may extend from a first location within the interior space 84, through the wire-supporting member 16, to another location within the interior space 84. Thus, the wire 46 may extend completely through the movable partition 60 or may extend only partially through the movable partition 60. Portions of the wire 46 may extend beyond the interior space 84 such that the terminal ends of the wire 46 are located outside the interior space 84. Accordingly, at least a portion of the wire 46 may be suspended from and supported by the wire support 10. The wire support 10 may be configured to support only the wire 46 or plurality of wires 46, while other electrical components (e.g., the control system 90 and the electric drive motor 102) may be supported by other structures (e.g., the movable partition 60 or a surface of the pocket 68). Thus, the sole electrical component supported by the wire supports 10 may be the wire 46 and the wire supports 10 may be left free from attachment to any other electrical component in some embodiments. In other embodiments, the wire supports 10 may support other electrical components, such as, for example, switches, sensors, electric motors, components of the automatic drive system 86, or other electrical components known in the art for use with a movable partition system 58.

The wire 46 extending in the interior space 84 (see FIG. 7) may connect components of the movable partition system 58 to one another. For example, a plurality of wires 46 may extend from a location at or near the first end 76 of the movable partition 60 to a location at or near the second, opposing end 82 of the movable partition 60. The plurality of wires 46 may connect, for example, one of an electric drive motor 102, a switch, a sensor, an alarm, an electrical power source, a control system 90, or other electrical components known in the art for use in a movable partition system 58 to another of the electric drive motor 102, the switch, the sensor, the alarm, the electrical power source, the control system 90, or other electrical components known in the art for use in a movable partition system 58. For example, the plurality of wires 46 may connect an AC or a DC electrical power source to an electric drive motor 102. In addition, the plurality of wires 46 may electrically interconnect switches, sensors, and controllers of one or more electronic systems of the movable partition system 58, such as an alarm system, a monitoring system, and the control systems 90.

As the wire 46 extends in the interior space 84 (see FIG. 7), portions of the wire 46 may be supported by components of the movable partition system 58. For example, a portion of the wire 46 located near the second, opposing end 82 of the movable partition 60 may be supported by a relief connection 104 located proximate the second, opposing end 82. For example, the wire 46 may be connected to the control system 90 within the pocket 68 and supported by a relief connection 104 comprising a cable tie or other device for securing a wire 46 to another structure attached to a control box 106 containing the control system 90. As a specific, nonlimiting example, an end of the wire 46 located proximate the second, opposing end 82 of the movable partition 60 may be connected to the control system 90, extend through a hole or gap in the control box 106 into the pocket 68, be secured to the control box 106 using a relief connection 104 (e.g., a cable tie), and extend into the interior space 84 by passing through a hole or gap in the floating jamb 92.

Portions of the wire 46 located between the second, opposing end 82 and the first end 76 of the movable partition 60 may be supported by wire-supporting members 16 of wire supports 10, which are rotatably connected to cantilever members 12 secured to panels 64 of the sheet of panels 62. For example, a wire support 10 may be added for at least about every 10 feet (3.05 m) that a movable partition 60 must extend to reach a fully deployed state. Thus, for movable partitions 60 that must extend for between about 10 feet (3.05 m) and about 20 feet (6.10 m) to reach a fully deployed state, at least one wire support 10 may support wire 46 extending between the first and second, opposing ends 76 and 82 of the movable partitions 60. For movable partitions 60 that must extend for between about 20 feet (6.10 m) and about 30 feet (9.14 m) to reach a fully deployed state, at least two wire supports 10 may support wire 46 extending between the first and second, opposing ends 76 and 82 of the movable partitions 60. Thus, movable partition systems 58 may comprise one wire support 10 or a plurality of wire supports 10 disposed in the interior space 84 between first and second sheets of panels 62A and 62B (see FIG. 7).

Finally, a portion of the wire 46 located near the first end 76 of the movable partition 60 may be supported by a relief connection 104 located proximate the first end 76. For example, the wire 46 may be connected to the electric drive motor 102 located at or near the first end 76 and carried by the movable partition 60, and a portion of the wire 46 proximate the electric drive motor 102 may be supported by a relief connection 104 attached to the automatic drive system 86 containing the electric drive motor 102. Thus, the weight of the wire 46, vertical forces acting on the wire 46, and vertical force components acting on the wire 46 may be supported by components of the movable partition system 58 other than the electrical connections to electrical components, which may reduce strain on the electrical connections.

When the movable partition 60 is in a collapsed state within the pocket 68, the wire 46 may hang from the relief connections 104 and the wire-supporting members 16 of the wire supports 10 toward a floor 108 or other bottom surface. For example, the wire 46 may be at least 12 inches (30.48 cm) away from the floor 108, at least 6 inches (15.24 cm) away from the floor 108, or at least 1 inch (2.54 cm) away from the floor 108 at its lowest points when the movable partition 60 is in a collapsed state. As the movable partition 60 extends from a collapsed state to a deployed state, the wire supports 10 supporting the wire 46 may move along with the panels 64 to which they are secured while the lowest points of the wire 46 raise with respect to the floor 108 toward the track 72 so that the wire 46 may maintain the electrical connections between components of the movable partition system 58.

As compared to movable partition systems where wire is connected to one of the movable partitions using clips to support the wires as they extend from the proximal end to the distal end of the movable partition system, the wire supports 10 may enable wire 46 to provide a more reliable electrical connection because the wire 46 is not forced to conform to the accordion-like bending of the sheets of panels 62A and 62B. In addition, the wire supports 10 may enable thicker wire 46 to be used because such wire 46 does not have to conform to the accordion-like bending of the sheets of panels 62A and 62B. The wire supports 10 may also enable the wire 46 to provide a more reliable electrical connection because air within the interior space 84 acts as a buffer between the wire 46 and surfaces (e.g., panels 64) that may be directly exposed to fire (e.g., when the movable partition 60 acts as a barrier to fire). The wire supports 10 may enable shorter lengths of wire 46 to be used because the wire may have a more direct path between the components connected to the wire 46. For example, the wire supports 10 may enable a length of wire 46 that is about three-fourths as long, two-thirds as long, or even one-half as long as a length of wire 46 connected to the same movable partition 60 using clips connected to panels 64. The wire supports 10 may enable faster and simpler installation because fewer structures (e.g., wire supports 10 and relief connections 104) are required to support the wire 46.

While the present invention has been described herein with respect to certain embodiments, those of ordinary skill in the art will recognize and appreciate that it is not so limited. Rather, many additions, deletions, and modifications to the embodiments described herein may be made without departing from the scope of the invention as hereinafter claimed, including legal equivalents. In addition, features from one embodiment may be combined with features of another embodiment while still being encompassed within the scope of the invention as contemplated by the inventor.

CONCLUSION

In some embodiments, wire supports for use with a movable partition system comprise a cantilever member configured for connection to a panel of a movable partition. A wire-supporting member through which wire may be inserted is rotatably connected to the cantilever member.

In other embodiments, movable partition systems comprise a movable partition comprising at least two sheets of panels extending at least substantially parallel to one another and laterally distanced from one another to define an interior space between the at least two sheets of panels, each sheet of panels comprising a plurality of interconnected panels joined by hinges or hinge-like members. At least one wire extends in the interior space. At least one wire support disposed in the interior space between a first end and a second, opposing end of the movable partition comprises a cantilever member secured to at least one panel of one of the at least two sheets of panels and a wire-supporting member rotatably connected to the cantilever member at least partially supporting the at least one wire inserted through the wire-supporting member.

In further embodiments, methods of installing a movable partition system comprise suspending a movable partition comprising at least two sheets of panels from a track, each sheet of panels comprising a plurality of interconnected panels joined by hinges or hinge-like members, the at least two sheets of panels extending at least substantially parallel to one another and laterally distanced from one another to define an interior space between the at least two sheets of panels. A cantilever member of at least one wire support including a wire-supporting member rotatably connected to the cantilever member is secured to at least one panel of one of the at least two sheets of panels in the interior space and between a first end and a second, opposing end of the movable partition. At least one wire is suspended from the at least one wire support by threading the at least one wire through the wire-supporting member.

What is claimed is:

1. A movable partition system, comprising:

a movable partition comprising at least two sheets of panels, the at least two sheets of panels extending at least substantially parallel to one another and laterally distanced from one another to define an interior space between the at least two sheets of panels, each sheet of panels comprising a plurality of interconnected panels joined by hinge members;

at least one wire extending in the interior space; and at least one wire support disposed in the interior space between a first end and a second, opposing end of the movable partition, the at least one wire support comprising a cantilever member secured to at least one panel of one of the at least two sheets of panels and a wire-supporting member rotatably connected to the cantilever member at least partially supporting the at least one wire inserted through the wire-supporting member, wherein wire-supporting member is positioned at least substantially equidistant from the at least two sheets of panels.

2. The movable partition system of claim 1, wherein the only electrical component supported by the at least one wire support comprises the at least one wire.

3. The movable partition system of claim 1, further comprising at least one wire support for about every 10 feet (3.05 m) that the movable partition must extend to reach a fully deployed state.

4. The movable partition system of claim 1, further comprising one of a floating jamb and a fixed jamb connected to the movable partition at the first end and a lead post connected to the movable partition at the second, opposing end.

5. The movable partition system of claim 1, wherein portions of the at least one wire located proximate the first and second, opposing ends of the movable partition are supported by relief connections securing the portions of the at least one wire to components of the movable partition system.

6. The movable partition system of claim 5, wherein the relief connections comprise cable ties securing the portions of the at least one wire to components of the movable partition system.

7. The movable partition system of claim 5, wherein the relief connections secure a first portion of the at least one wire to a first component of the movable partition system located proximate the first end and a second portion of the at least one wire to a second component of the movable partition system located proximate the second, opposing end.

8. The movable partition system of claim 7, wherein a first end of the at least one wire is connected to at least one of an alarm system, a partition monitoring system, a partition control system, and an automatic drive system and a second end of the at least one wire is connected to another of the alarm system, the partition monitoring system, the partition control system, and the automatic drive system.

9. The movable partition system of claim 1, wherein portions of the at least one wire extending from two opposing sides of the wire-supporting member are secured to one another.

10. The movable partition system of claim 9, wherein a retaining member secures the portions of the at least one wire extending from two opposing sides of the wire-supporting member to one another.

11. The movable partition system of claim 10, wherein the retaining member comprises a cable tie.

12. The movable partition system of claim 1, further comprising retaining members having a diameter larger than a diameter of a space defined by the wire-supporting member through which the at least one wire extends attached to portions of the at least one wire extending from two opposing sides of the wire-supporting member.

13. The movable partition system of claim 1, wherein at least one end of the at least one wire is connected to at least one of an electric drive motor, a switch, a sensor, an alarm, a control system, and an electrical power source.

14. The movable partition system of claim 1, wherein the at least one wire comprises a plurality of wires.

15. The movable partition system of claim 1, wherein the at least one wire support comprises a plurality of wire supports.

16. The movable partition system of claim 1, wherein an end of the cantilever member opposing an end of the cantilever member to which the wire-supporting member is rotatably attached abuts against a hinge member connected to the at least one panel to which the cantilever member is secured.

17. The movable partition system of claim 1, wherein the cantilever member is secured to the at least one panel using at least one of at least one screw, at least one nut and bolt, at least one rivet, at least one adhesive, and at least one weld.

18. The movable partition system of claim 1, wherein the wire-supporting member is within about 1 inch (2.54 cm) from a location equidistant from the at least two sheets of panels.

19. A method of installing a movable partition system, comprising:

suspending a movable partition comprising at least two sheets of panels from a track, each sheet of panels comprising a plurality of interconnected panels joined by hinge members, the at least two sheets of panels extending at least substantially parallel to one another and laterally distanced from one another to define an interior space between the at least two sheets of panels;

securing a cantilever member of at least one wire support to at least one panel of one of the at least two sheets of panels in the interior space and between a first end and a second, opposing end of the movable partition, the at least one wire support including a wire-supporting member rotatably connected to the cantilever member;

positioning the wire-supporting member at least substantially equidistant from the at least two sheets of panels; and suspending at least one wire from the at least one wire support by threading the at least one wire through the wire-supporting member.

20. The method of installing a movable partition system of claim 19, further comprising leaving the at least one wire support free from attachment to any other electrical component.

21. The method of installing a movable partition system of claim 19, wherein securing the cantilever member of the at least one wire support to the at least one panel of one of the at least two sheets of panels comprises securing the cantilever member of each of a plurality of wire supports to respective panels of the at least two sheets of panels.

22. The method of installing a movable partition system of claim 19, wherein securing the cantilever member of the at least one wire support to the at least one panel of one of the at least two sheets of panels comprises securing the cantilever member of the at least one wire support to the at least one panel of one of the at least two sheets of panels prior to suspending the movable partition from the track.

23. The method of claim 19, further comprising connecting one of a floating jamb and a fixed jamb to the movable partition at the first end and connecting a lead post to the movable partition at the second, opposing end.

24. The method of claim 19, further comprising supporting portions of the at least one wire located proximate the first and second, opposing ends of the at least two movable partitions using relief connections.

25. The method of claim 19, further comprising securing portions of the at least one wire extending from two opposing sides of the wire-supporting member to one another.

26. The method of claim 19, further comprising connecting at least one end of the at least one wire to at least one of an electric drive motor, a switch, a sensor, an alarm, a control system, and an electrical power source.

27. The method of claim 19, wherein securing the cantilever member of the at least one wire support to the at least one panel comprises at least one of screwing, bolting, riveting, adhering, and welding the cantilever member to the at least one panel.

* * * * *